US006579171B2

(12) United States Patent
Lawless, III et al.

(10) Patent No.: US 6,579,171 B2
(45) Date of Patent: Jun. 17, 2003

(54) VENTILATION ASSEMBLY

(75) Inventors: Jack Lawless, III, Northville, MI (US); Charles Schiedegger, Metamora, MI (US); J. Richard Logan, Oxford, MI (US); Barton Gentsch, Lapeer, MI (US)

(73) Assignee: Tapco International, Plymouth, MI (US)

( * ) Notice: Subject to any disclaimer, the term of this patent is extended or adjusted under 35 U.S.C. 154(b) by 0 days.

(21) Appl. No.: 09/953,652

(22) Filed: Sep. 17, 2001

(65) Prior Publication Data

US 2002/0032000 A1 Mar. 14, 2002

Related U.S. Application Data

(62) Division of application No. 09/583,799, filed on May 31, 2000.

(60) Provisional application No. 60/137,002, filed on Jun. 1, 1999.

(51) Int. Cl.[7] ..... F24F 7/02

(52) U.S. Cl. ..... 454/365; 52/198

(58) Field of Search ..... 454/277, 365, 454/364, 366; 52/199, 198, 57

(56) References Cited

U.S. PATENT DOCUMENTS

| | | | | |
|---|---|---|---|---|
| 4,325,290 A | | 4/1982 | Wolfert | |
| 4,625,630 A | | 12/1986 | Carroll et al. | |
| 4,642,958 A | | 2/1987 | Pewitt | |
| 4,666,479 A | * | 5/1987 | Shoji | 206/454 |
| 4,817,506 A | | 4/1989 | Cashman | |
| 4,850,166 A | | 7/1989 | Taylor | |
| 4,924,761 A | | 5/1990 | MacLeod et al. | |
| 4,995,308 A | | 2/1991 | Waggoner | |
| 5,009,149 A | | 4/1991 | MacLeod et al. | |
| 5,022,314 A | * | 6/1991 | Waggoner | 454/277 |
| 5,060,431 A | | 10/1991 | MacLeod et al. | |
| 5,122,095 A | | 6/1992 | Wolfert | |
| 5,174,076 A | | 12/1992 | Schiedegger et al. | |
| 5,288,269 A | | 2/1994 | Hansen | |
| 5,425,672 A | | 6/1995 | Rotter | |
| 5,458,538 A | | 10/1995 | MacLeod et al. | |
| 5,535,558 A | | 7/1996 | Rieke et al. | |
| 5,605,022 A | | 2/1997 | Fulton | |
| 5,632,678 A | | 5/1997 | Doelfel | |
| 5,830,059 A | | 11/1998 | Sells | |
| 5,946,868 A | | 9/1999 | Morris | |
| 5,947,817 A | | 9/1999 | Morris et al. | |

* cited by examiner

*Primary Examiner*—Derek S. Boles
(74) *Attorney, Agent, or Firm*—Howard & Howard

(57) ABSTRACT

A ventilation assembly for ventilating an attic of a building through an opening in the roof or wall of the building. The ventilation assembly includes a vent structure having a mounting portion securing the vent structure to the building over the opening. The vent structure further includes a vent portion having a series of walls defining a series of unimpeded fluid passageways for providing unobstructed fluid flow through the vent portion over the opening. The ventilation assembly includes a partially porous membrane mounted to the roof or wall over the opening and spaced from the fluid passageway to maintain the unobstructed fluid flow through the fluid passageway. The membrane also creates a barrier for preventing the intrusion of particles, debris, insects and the like into the opening while allowing the ventilating to occur. The ventilation assembly may also include a series of ribs defining a series of troughs disposed between the upstanding walls for directing a flow of material away from the ventilation assembly while allowing the ventilating to occur.

9 Claims, 5 Drawing Sheets

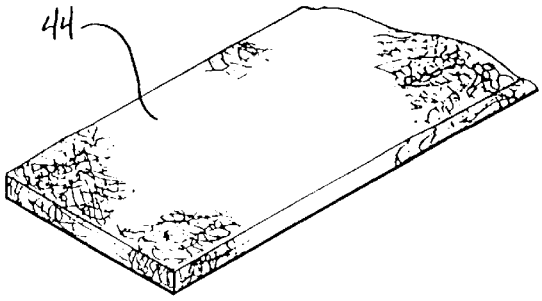
FIG-3A
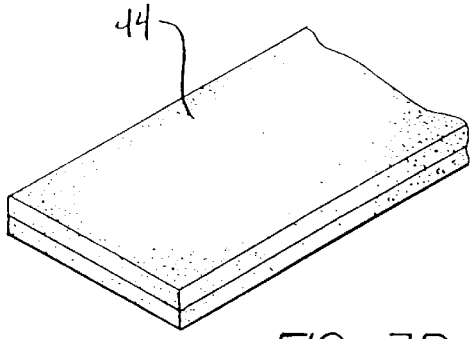
FIG-3B
FIG-4
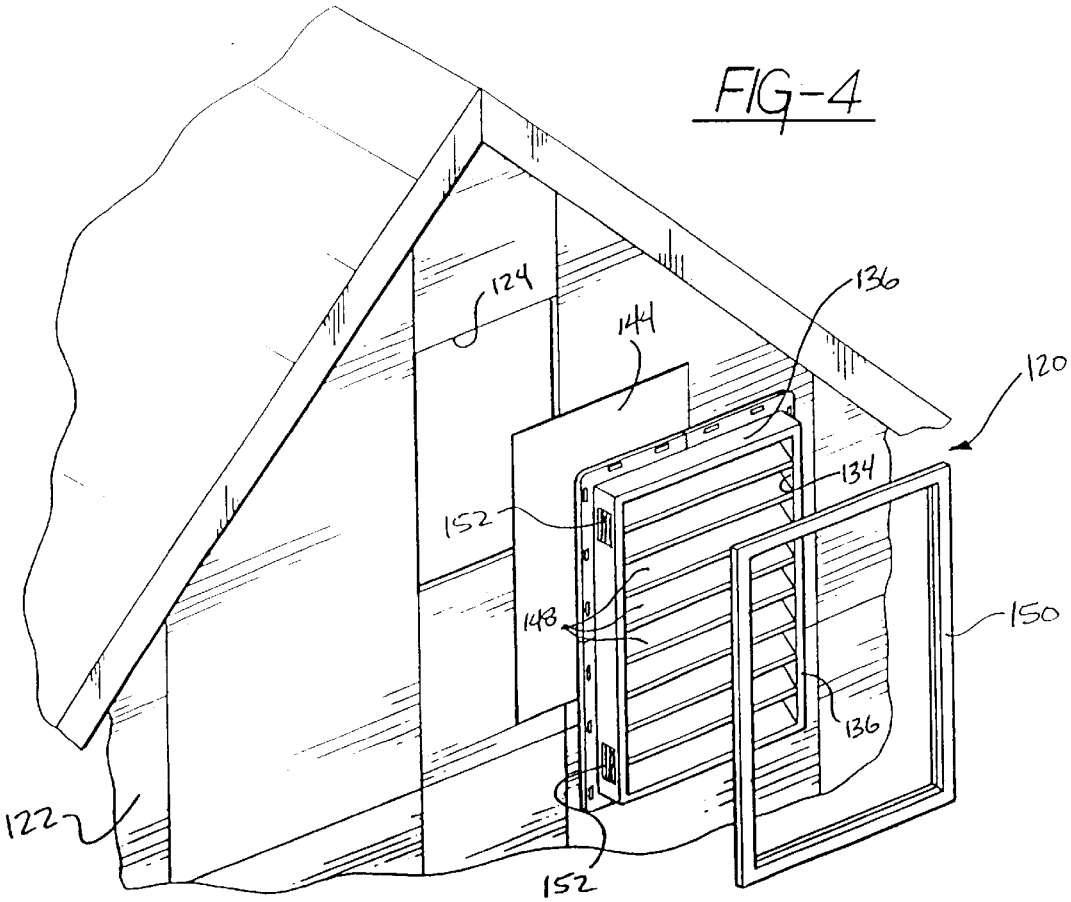

VENTILATION ASSEMBLY

RELATED APPLICATION

This patent application is a divisional application of U.S. Ser. No. 09/583,799 filed on May 31, 2000 and entitled "Roof Ventilation Assembly", which in turn claims priority to and all the benefits of U.S. Provisional Patent Application Serial No. 60/137,002 filed on Jun. 1, 1999 and entitled "Venting Membrane".

BACKGROUND OF THE INVENTION

1) Technical Field

The subject invention relates to a ventilation assembly for an attic of a building.

2) Description of the Prior Art

It is desirable to have an attic or upper story of a building be vented to the atmosphere to prevent heat build up within the attic. Poor attic ventilation can result in high air conditioning bills in the summer, excessive moisture retention in the winter, loss of insulation efficiency, and destruction of the roof itself.

A proper designed ventilation assembly, which can be a roof vent, gable vent, soffet vent, or the like, utilizes the natural forces of temperature and wind. The temperature force, or thermal effect, results from a temperature differential between the interior of the attic and the outside. In order to minimize the thermal effect within the attic, the ventilation assembly should be disposed at the highest possible elevation.

The force of the wind, or wind pressure, is created when the wind flows over the building which creates a vacuum therein. The vacuum produces a negative pressure area on the upwind side of the building and a positive pressure area on the downwind side of the building.

Roof ridge vents have become increasingly popular for providing the needed ventilation. Roof ridge vents extend along the ridge of a pitched roof and cover a ventilating opening that is cut longitudinally in the roof. Many of the prior art ridge vents work in conjunction with a gable vent such that the gable vent draws air into the attic and the air then exhausts out the ridge vent. The ridge vents typically include filters or screens disposed within the vent itself to prevent the intrusion of particles, snow, debris, insects and the like. However, the filters or screens disposed within the path of airflow restrict the uniform flow of air through the vent. Examples of this type of ridge vent configuration are shown in U.S. Pat. Nos. 4,325,290; 4,817,506; 4,924,761; 5,122,095; and 5,830,059.

In order to increase the air flow through the ridge roof vent and to thereby increase the efficiency of the roof vent, it is desirable to remove any filter or screen from the air passageways of the vent to allow unobstructed air flow through the vent while still preventing the intrusion of particles, debris, insects and the like. In addition, the unimpeded roof vent should also be able to redirect the intrusion of water, snow, debris and the like away from the roof vent. Finally, it is desirable to roll the entire roof vent assembly into a single coil such that the coil may be unrolled on top of the roof, thereby increasing the efficiency of the installation process.

SUMMARY OF THE INVENTION AND ADVANTAGES

The deficiencies in the prior art are overcome by providing a ventilation assembly for ventilating at least a portion of a building through at least one opening in the building. The ventilation assembly comprises a vent structure having a mounting portion adapted for securing the vent structure to the building over the opening. The vent structure further includes a vent portion having a plurality of upstanding walls defining at least one unimpeded fluid passageway for providing unobstructed fluid flow through the vent portion over the opening. The ventilation assembly is characterized by an at least partially porous membrane disposed adjacent the vent portion and spaced from the fluid passageway to maintain the unobstructed fluid flow through the fluid passageway. The membrane is adapted for being mounted over the opening in the building to create a barrier for preventing the intrusion of particles into the opening while allowing the ventilating to occur. The ventilation assembly may also include a plurality of upwardly extending ribs defining a plurality of troughs disposed between the upstanding walls for directing a flow of material away from the ventilation assembly while allowing the ventilating to occur.

The subject ventilation assembly further includes a process of installing a roof ventilation assembly over an opening of a roof. The process includes the steps of; rolling the vent structure and membrane into a single coil during the manufacture of the roof ventilation assembly, unrolling the coil of the vent structure and membrane onto the roof over the opening, securing portions of the membrane to the roof over the opening, and securing portions of the vent structure to the roof over the membrane.

Accordingly, the subject invention provides for a ventilation assembly which maintains an unobstructed fluid passageway through the vent itself while still preventing the intrusion of particles, debris, insects and the like. Further, the unimpeded roof vent redirects the intrusion of water, snow, debris and the like away from the roof vent. Finally, the subject ventilation assembly is rolled into a single coil such that the coil may be unrolled on top of the roof which increases the efficiency of the installation process.

BRIEF DESCRIPTION OF THE DRAWINGS

Other advantages of the present invention will be readily appreciated as the same becomes better understood by reference to the following detailed description when considered in connection with the accompanying drawings wherein:

FIG. 3A is a perspective view of an alternative embodiment of a membrane;

FIG. 3B is a perspective view of another alternative embodiment of the membrane;

FIG. 4 is a perspective view of an alternative embodiment of the ventilation assembly;

DETAILED DESCRIPTION OF THE PREFERRED EMBODIMENT

Figure 1:
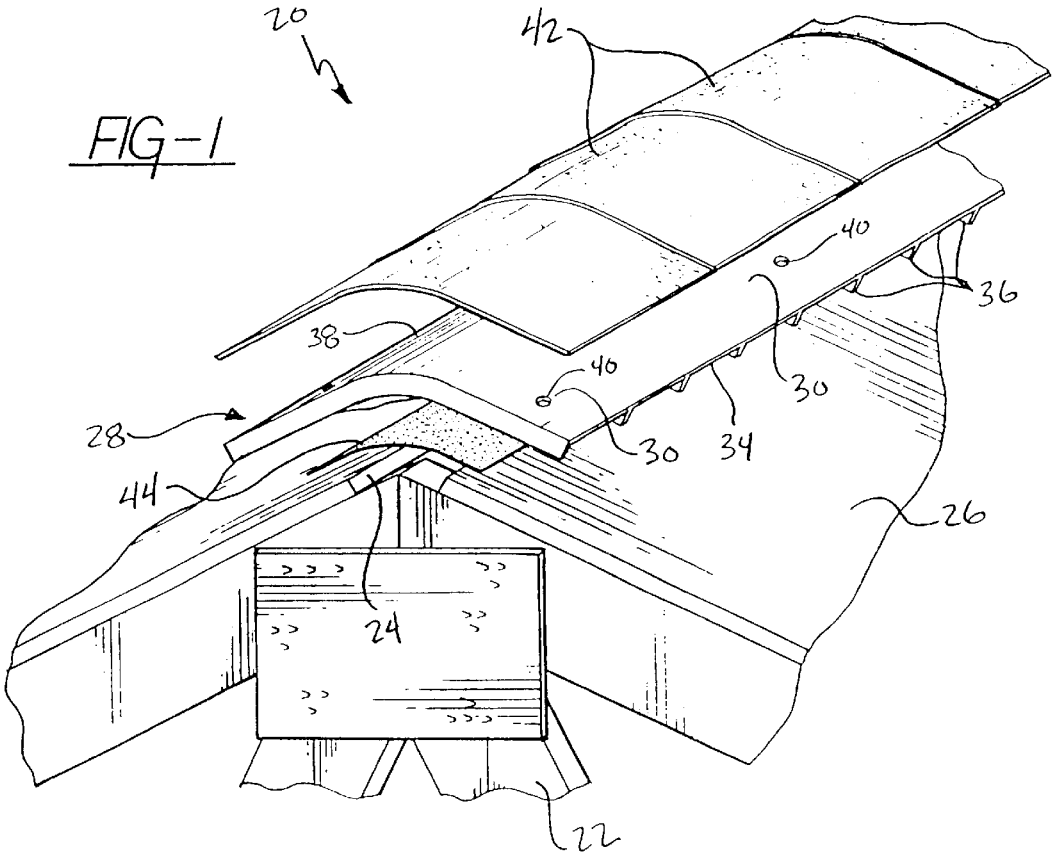
FIG. 1 is a perspective view of a ventilation assembly in accordance with the subject invention.
Figure 2:
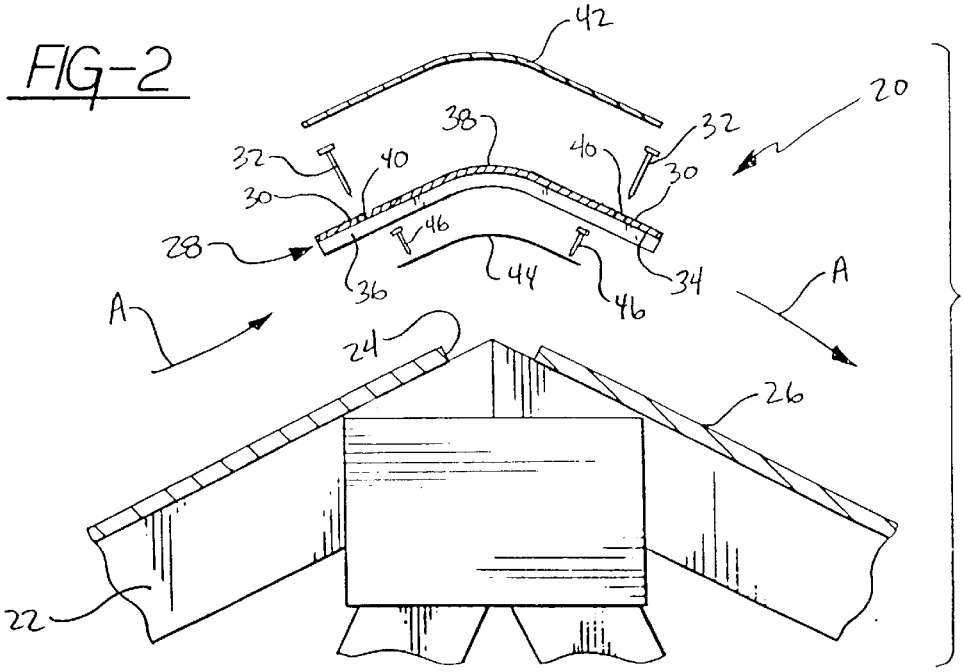
FIG. 2 is a is a cross-sectional side view of the ventilation assembly of FIG. 1.
Figure 5:
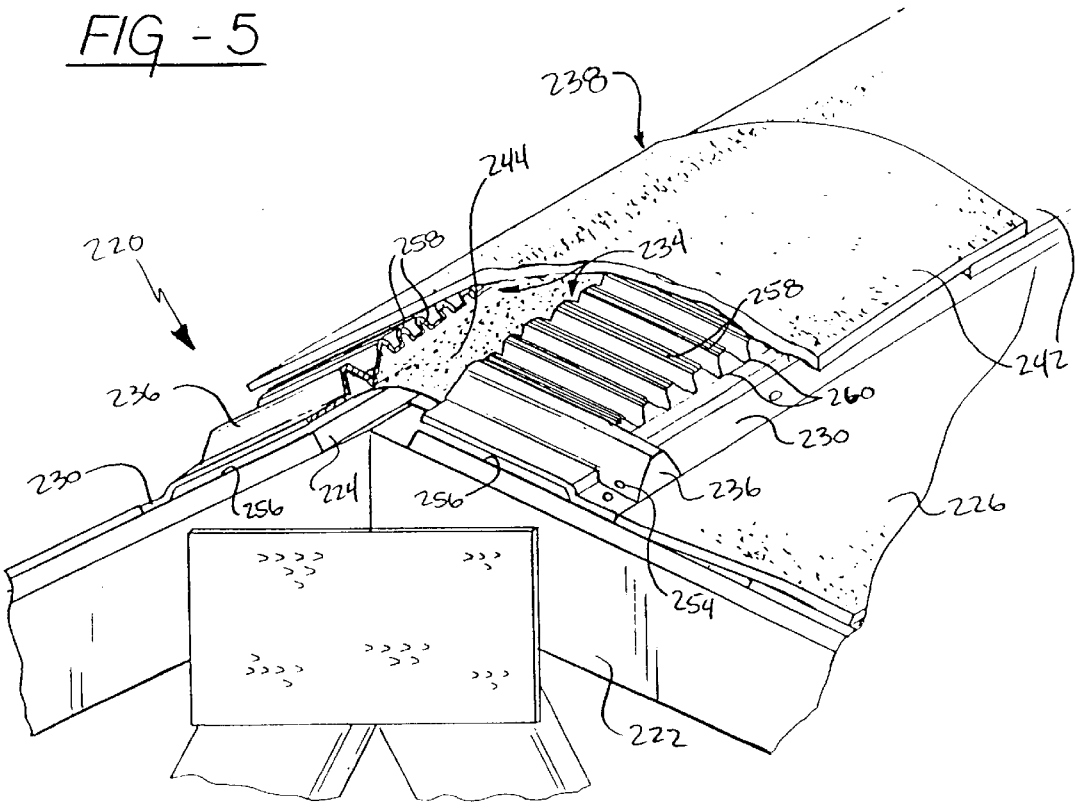
FIG. 5 is a perspective view of another alternative embodiment of the ventilation assembly.

Referring to the Figures, wherein like numerals indicate like or corresponding parts throughout the several views, a ventilation assembly is generally shown at 20 in FIGS. 1 and 2. The ventilation assembly 20 ventilates at least a portion of a building 22 through at least one opening 24 in the building 22.

Preferably, the ventilation assembly 20 is a ridge roof vent ventilating at least a portion of an attic or upper portion of the building 22 through at least one opening 24 in a roof 26. The ridge roof vent extends along a ridge of a pitched roof 26 and covers a ventilating opening 24 that is cut longitudinally in the roof 26. The purpose of the subject invention is to offer a simple, effective way to vent attic spaces under building roofs while preventing entrance of rain, snow, insects, or vermin into the attic spaces.

As appreciated, the subject ventilation assembly 20 may be utilized for other types of roof vents, gable vents, soffet vents, or the like without deviating from the overall scope of the subject invention. Further, the ventilation assembly 20 is not limited for use with inclined roofs and can be adapted for other roof arrangements. The illustration and discussion of the subject invention as a ridge roof vent is in no way intended to limit the subject invention to this particular embodiment. In fact, one such alternative is illustrated in FIG. 4 as will be subsequently discussed.

The ventilation assembly 20 of FIGS. 1 and 2 comprises a vent structure, generally shown at 28, having a mounting portion 30 adapted for securing the vent structure 28 to the building 22 over the opening 24. Preferably, nails 32 extend through the mounting portion 30 to secure the vent structure 28.

The vent structure 28 further includes a vent portion 34 having a plurality of upstanding walls 36 defining at least one unimpeded fluid passageway for providing unobstructed fluid flow through the vent portion 34 over the opening 24. As best illustrated in FIG. 2, air, such as from wind, can flow through the vent portion 34 without any obstructions. The flow of air is illustrated as arrow A. The easily flowing air creates the desired vacuum effect across the opening 24 in the roof 26. The upstanding walls 36 are preferably parallel and spaced equidistantly apart. A cover portion 38 interconnects the upstanding walls 36 and further defines the fluid passageways. In the embodiment of FIGS. 1 and 2, the mounting portion 30 is incorporated into sections of the cover portion 38. In particular, holes 40 are formed within the cover portion 38 such that the nails 32 may pass through the vent structure 28 to secure the vent structure 28.

Preferably, the upstanding walls 36, the mounting portion 30, and the cover portion 38 form an integral one-piece vent structure 28. Even more preferably, the one-piece vent structure 28 is formed of a homogenous plastic material which can be rolled into a coil as will be subsequently discussed.

Shingles 42, which typically match the shingles on the roof 26, are mounted to the cover portion 38 to provide an aesthetically pleasing ventilation assembly 20 at the ridge of the roof 26. The shingles 42 may be secured to the roof ventilation assembly 20 in any suitable manner such as adhesive, nails or the like.

The ventilation assembly 20 is characterized by an at least partially porous film or membrane 44 disposed adjacent the vent portion 34 and spaced from the fluid passageway to maintain the unobstructed fluid flow through the fluid passageway. The membrane 44 is adapted for being mounted over the opening 24 in the building 22 to create a barrier for preventing the intrusion of particles into the opening 24 while allowing the ventilating to occur. Preferably, the membrane 44 is secured to the roof 26 by a series of nails 46. The membrane 44 may be of any suitable breathable material which allows fluid flow therethrough and prevents the intrusion of particles, snow, debris, insects, vermin and the like, even in high wind conditions. The membrane 44 allows air to vent from the attic due to small openings in the film or membrane 44 which is created by either a composite of materials or microperforating a film. As illustrated in FIGS. 1 and 2, the membrane 44 is further defined as a polymer, preferably plastic, film 44 having a plurality of microperforated holes. Referring to FIG. 3A, the membrane 44 is further defined as a plurality of woven or extruded polymer, preferably polyethylene, fibers 44. Turning to FIG. 3B, the membrane 44 is further defined as a breathable multi-layered fiber composite 44. Preferably the fiber composite is similar to those used in the clothing industry, one of which is branded as GORE-TEX™. As appreciated, the membrane 44 may be formed of other suitable materials as well, such as a porous sponge having large holes, a fabric like material having a plurality of holes or the like.

Referring now to FIG. 4, an alternative embodiment of the subject invention is shown wherein like numerals increased by 100 indicate like or corresponding parts throughout the Figure. The ventilation assembly is a gable type vent generally shown at 120. A membrane 144 is illustrated as covering an opening 124 in a side wall of a building 122. A vent portion 134 has a plurality of louvers 148 disposed between a number of upstanding walls 136 for providing the ventilating. The upstanding walls 136 of the gable type ventilation assembly 120 form a square vent portion 134. As appreciated, the subject gable type ventilation assembly 120 may be of any suitable design or configuration.

An exterior flange portion 150 telescopes over the vent portion 134 and is adapted to overly a portion of abutting siding (not shown). Interlocking members 152 are disposed between the vent portion 134 and the flange portion 150 for positioning the flange portion 150 at predetermined distances relative to the vent portion 134. The interlocking members 152 increase the versatility of the gable type ventilation assembly 120 in that the vent portion 134 and flange portion 150 can accommodate a range of siding thicknesses.

Referring to FIGS. 5 through 11, another alternative embodiment of the ventilation assembly is shown wherein like numerals increased by 200 indicate like or corresponding parts. The ventilation assembly 220 of this embodiment is also a ridge roof vent for ventilating at least a portion of an attic or upper portion of a building 222 through at least one opening 224 in a roof 226.

The ventilation assembly 220 comprises a mounting portion 230 adapted for securing the roof ventilation assembly 220 to the roof 226 over the opening 224. An adhesive seal 253 is secured to the mounting portion 230. The seal 253 is preferably applied to the mounting portion 230 during the manufacture of the ventilation assembly 220. The seal 253 is a double sided adhesive that has a releasable plastic (not shown) disposed thereon. During the installation of the ventilation assembly 220 the plastic is removed and the seal 253 adheres to the roof 226 to secure the ventilation assembly 220 to the roof 226. The seal 253 may adhere to the plywood roof 226 (as shown) or to a series of shingles 242 on the roof 226. The seal 253 creates an ice and water shield and may be made of any suitable roofing adhesive as is known in the art. The mounting portion 230 may also be secured to the roof 226 by a series of nails 232.

A plurality of upstanding walls 236 extend from the mounting portion 230 and are adapted for supporting a cover portion 238. The upstanding walls 236 have a hollow triangular shaped configuration defining at least one drain hole 254 (best shown in FIG. 8). The cover portion 238 is preferably a series of shingles 242 which match the shingles 242 of the roof 226. As appreciated, the cover portion 238 may be any suitable plastic, wood, or the like cover.

Figure 6:
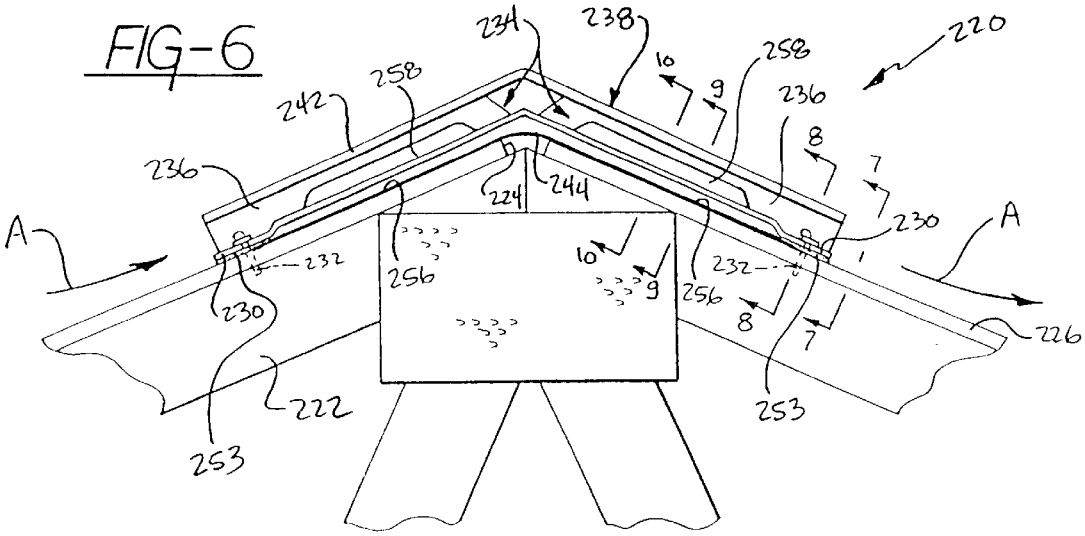
FIG. 6 is a side view of the ventilation assembly of FIG. 5.
Figure 7:
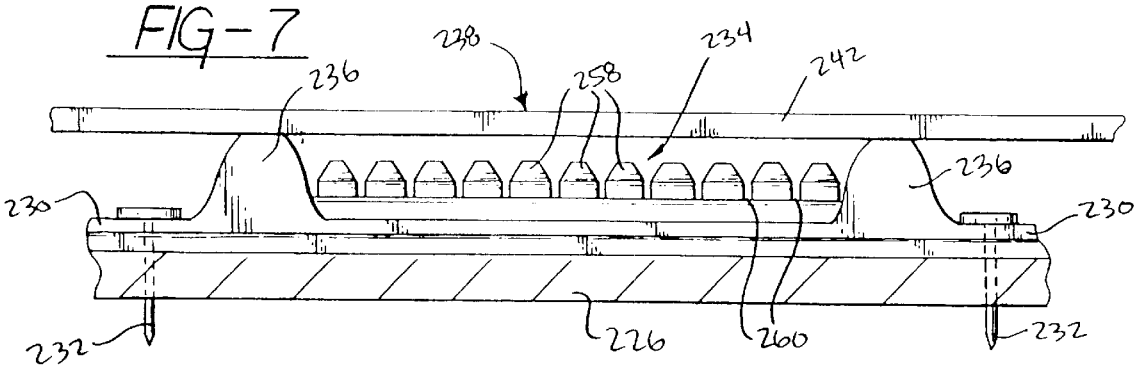
FIG. 7 is a cross-sectional view taken along line 7—7 of FIG. 6.
Figure 8:
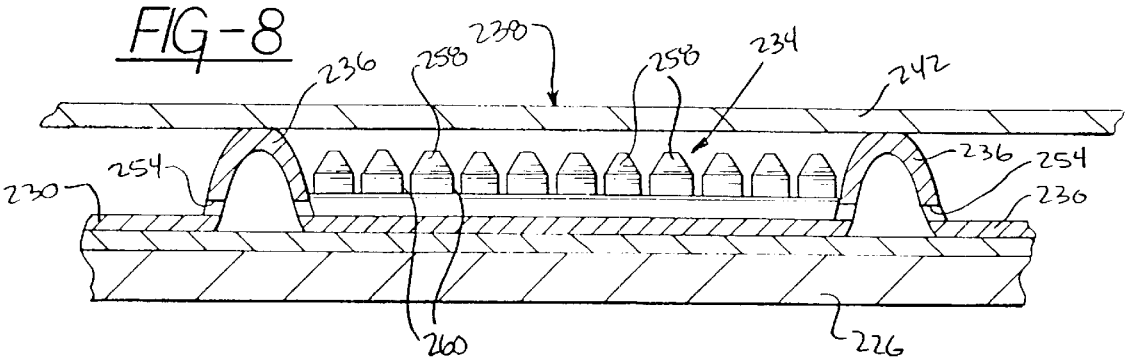
FIG. 8 is a cross-sectional view taken along line 8—8 of FIG. 6.

A vent portion 234 interconnects the upstanding walls 236 and defines at least one unimpeded fluid passageway for providing unobstructed fluid flow through the vent portion 234 over the opening 224. As best illustrated in FIG. 6, air, such as from wind, can flow through the vent portion 234 without any obstructions. The flow of air is illustrated as arrow A. The easily flowing air creates the desired vacuum effect across the opening 224 in the roof 226. The vent portion 234 is raised from the mounting portion 230 between the walls 236 above the roof 226 itself to define a vent chamber 256.

The roof ventilation assembly 220 of this embodiment is characterized by the vent portion 234 including a plurality of upwardly extending ribs 258 defining a plurality of troughs 260 disposed between the upstanding walls 236 for directing a flow of material away from the roof ventilation assembly 220 while allowing the ventilating to occur. The ribs 258 extend upward from the raised vent portion 234 to a spaced below the cover portion 238, i.e., below the shingles 242.

Figure 9:
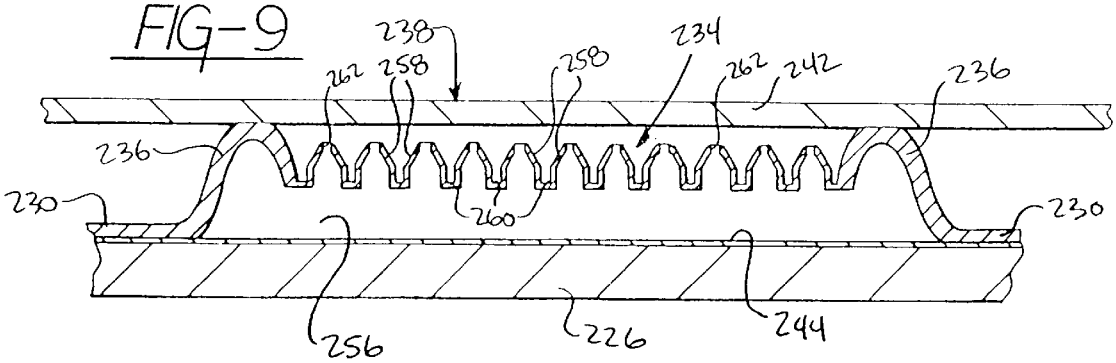
FIG. 9 is a cross-sectional view taken along line 9—9 of FIG. 6.
Figure 10:
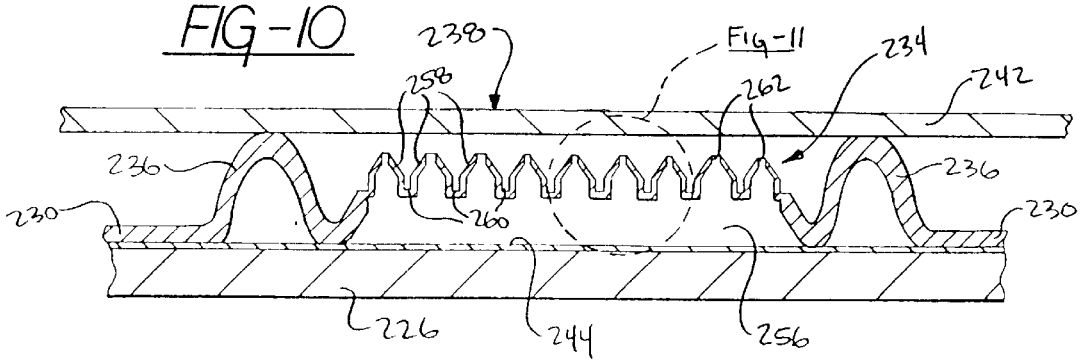
FIG. 10 is a cross-sectional view taken along line 10—10 of FIG. 6.
Figure 11:
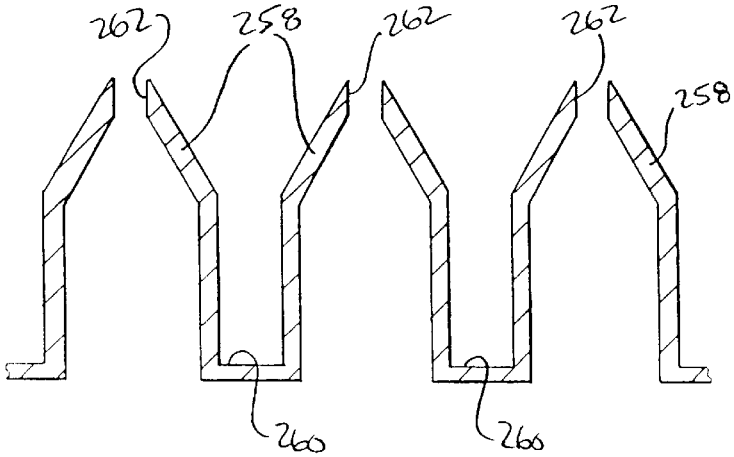
FIG. 11 is an enlarged cross-sectional view of a plurality of ribs in accordance with the ventilation assembly of FIG. 10.

As best shown in FIGS. 9 through 11, each of the ribs 258 include an upper tip opposite the troughs 260 with an opening 262 disposed within each of the tips. The openings 262 in the tips fluidly connect the fluid passageway to the vent chamber 256 and the opening 224 in the roof 226. Hence, exhausting air will pass through the opening 224 in the roof 226, into the vent chamber 256, upwardly into each of the ribs 258, outward through the openings 262 in the tips of the ribs 258, and out through the fluid passageway to the atmosphere. The ribs 258 extend continuously between the walls 236 to form a plurality of undulating ribs 258 and troughs 260.

Preferably, the upstanding walls 236, the mounting portion 230, and the vent portion 234, including the ribs 258 and troughs 260, form an integral one-piece roof ventilation assembly 220. Even more preferably, the one-piece roof ventilation assembly 220 is formed of a homogenous plastic material which can be rolled into a coil as discussed below.

An at least partially porous membrane 244 is also provided adjacent the vent portion 234. The membrane 244 is spaced from the vent chamber 256 and the fluid passageway to maintain the unobstructed fluid flow through the fluid passageway. The membrane 244 is adapted for being mounted over the opening 224 in the building 222 to create a barrier for preventing the intrusion of particles into the opening 224 while allowing the ventilating to occur. The membrane 244 is preferably captured under the adhesive seal 253 of the mounting portion 230 in order to secure the membrane 244 to the roof 226. As appreciated, nails may also or alternatively be used to secure the membrane 244 to the roof 226. The membrane 244 of this embodiment is the substantially the same as the membrane 244 disclosed above. Hence, the membrane 244 may be a polymer film having a plurality microperforated of holes, a plurality of woven polymer fibers, a breathable multi-layered fiber composite, or any other suitable material.

Figure 12:
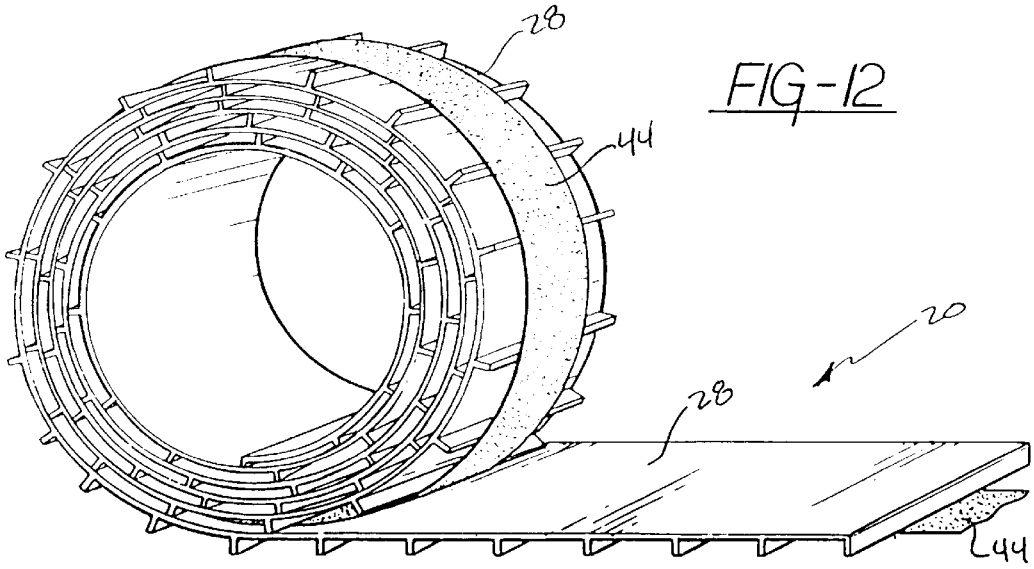
FIG. 12 is a perspective view of the ventilation assembly rolled into a single coil.

Referring to FIG. 12, the ventilation assembly 20 is shown rolled into a single coil. The coil significantly increases the installation process for the vent structure 28 and membrane 44. In particular, the process of installing the ventilation assembly 20 includes the steps of; rolling the vent structure 28 and membrane 44 into a single coil during the manufacture of the roof ventilation assembly 20, unrolling the coil of the vent structure 28 and membrane 44 onto the roof 26 over the opening 24, securing portions of the membrane 44 to the roof 26 over the opening 24, and securing portions of the vent structure 28 to the roof 26 over the membrane 44. The securing of the vent structure 28 and membrane 44 is further defined as nailing the vent structure 28 and membrane 44 to the roof 26 over the opening 24. The coiling of the ventilation assembly 20 increases the installation time, efficiency, and costs.

The invention has been described in an illustrative manner, and it is to be understood that the terminology which has been used is intended to be in the nature of words of description rather than of limitation. Many modifications and variations of the present invention are possible in light of the above teachings. It is, therefore, to be understood that within the scope of the appended claims the invention may be practiced otherwise than as specifically described.

What is claimed is:

1. A ventilation asembly for ventilating at least a portion of a building through at least one opening in the building, said ventilation assembly comprising;

a vent structure having a mounting portion adapted for securing said vent structure to the building over the opening;

said vent structure further including a cover portion having a width extending between opposing edges and having a predetermined length extending transverse to said width, said cover portion adapted for covering the opening in the building;

a plurality of spaced upstanding walls mounted to and extending from said cover portion to a distal end with each of said distal ends of said walls remaining unattached from a distal end of an adjacent wall such that said cover portion can flex and bend;

said upstanding walls being substantially continuous across said width between said opposing edges of said cover portion to define an unimpeded fluid passageway between adjacent walls for providing unobstructed fluid flow across said width of said vent structure over the opening from one of said edges of said cover portion to another of said edges of said cover portion while substantially preventing fluid flow across said length of said cover portion;

said support walls, said mounting portion, and said cover portion forming an integral one-piece vent structure; and an at least partially porous membrane underlying said walls and spaced from said fluid passageway to maintain said unobstructed fluid flow through said fluid passageway between said edges of said cover portion and adapted for being mounted over the opening in the building to create a barrier for preventing the intrusion of particles into the opening from said passageways between said walls while allowing the ventilating through said passageways between said edges to occur.

2. A ventilation assembly as set forth in claim 1 wherein said membrane is further defined as a plurality of woven polymer fibers.

3. A ventilation assembly as set forth in claim 1 wherein said membrane is further defined as a polymer film having a plurality of microperforated holes.

4. A ventilation assembly as set forth in claim 1 wherein said membrane is further defined as a breathable multi-layered fiber composite.

5. A ventilation assembly as set forth in claim 1 wherein said one- piece vent structure is formed of a homogenous plastic material.

6. A process of installing a roof ventilation assembly over an opening of a roof with the roof ventilation assembly including a vent structure and a membrane, the vent structure including a cover portion having a width extending between opposing edges and having a predetermined length extending transverse to the width, with a plurality of spaced upstanding walls mounted to and extending from the cover portion to a distal end, the upstanding walls being substantially continuous across the width between the opposing edges of the cover portion, said process including the steps of;

rolling the vent structure and membrane into a single coil during the manufacture of the roof ventilation assembly wherein the distal ends of the walls spread apart such that each distal end at least partially moves away from an adjacent distal end, unrolling the coil of the vent structure and membrane onto the roof over the opening at substantially the same time such that the membrane underlies the upstanding walls wherein the distal ends of the walls move toward each other to define a plurality of unimpeded fluid passageways between adjacent walls for providing unobstructed fluid flow across the width of the vent portion from one of the edges to another of the edges of the cover portion while substantially preventing fluid flow along the length of the cover portion, securing portion of the membrane to the roof over the opening, and securing portions of the vent structure to the roof over the memrbrane.

7. A process as set forth in claim 6 wherein the securing of the vent structure and membrane is further defined as nailing the vent structure and membrane to the roof over the opening.

8. A ventilation assembly as set forth in claim 1 wherein said substantially continuous upstanding walls prevent fluid flow along said predetermined length of said cover portion.

9. A process as set forth in claim 6 wherein the steps of securing the membrane to the roof and securing the vent structure to the roof are further defined as securing both the membrane and vent structure to the roof at substantially the same time.

* * * * *